US006125810A

United States Patent [19]

Haselkorn

[11] Patent Number: 6,125,810

[45] Date of Patent: Oct. 3, 2000

[54] CERAMIC VALVE GUIDE WITH TWO INTERNAL DIAMETERS

[75] Inventor: Michael H. Haselkorn, Dunlap, Ill.

[73] Assignee: Caterpillar Inc., Peoria, Ill.

[21] Appl. No.: 09/216,753

[22] Filed: Dec. 10, 1998

[51] Int. Cl.[7] ..... F02N 3/00

[52] U.S. Cl. ..... 123/188.9; 123/188.6

[58] Field of Search ..... 123/188.9, 188.5, 123/188.6

[56] References Cited

U.S. PATENT DOCUMENTS

| | | | |
|---|---|---|---|
| 1,972,650 | 9/1934 | Gassaway et al. | 123/188.9 |
| 2,722,925 | 11/1955 | McElhinney | 123/188.9 |
| 3,037,494 | 6/1962 | Kirkpatrick et al. | 123/188.9 |
| 4,688,527 | 8/1987 | Mott et al. | 123/188 AA |
| 5,372,103 | 12/1994 | Hackett et al. | 123/188.3 |
| 5,435,280 | 7/1995 | Hackett et al. | 123/188.9 |
| 5,539,980 | 7/1996 | Kammeraad et al. | 29/888.41 |
| 5,558,056 | 9/1996 | Sakata | 123/188.6 |
| 5,564,187 | 10/1996 | Sihon | 29/888.41 |
| 5,571,755 | 11/1996 | Haselkorn et al. | 501/32 |
| 5,571,756 | 11/1996 | Haselkorn et al. | 501/32 |
| 5,592,913 | 1/1997 | Matthews | 123/188.3 |
| 5,655,493 | 8/1997 | Enright et al. | 123/188.3 |
| 5,692,462 | 12/1997 | Hackett | 123/42 |

*Primary Examiner*—John Kwon
*Attorney, Agent, or Firm*—Howard & Howard

[57] ABSTRACT

Ceramic valve guides capable of withstanding high temperature ranges are typically used in high efficiency internal combustion engines. In very large engines these ceramic valve guides can be quite long and forming the required through bore in the ceramic valve guide to accommodate a stem of a valve can be extremely time consuming. A ceramic valve guide assembly is disclosed that provides a simple and economical means for creating a ceramic valve guide assembly. In one embodiment, the valve guide assembly comprises a first valve guide sleeve that is identical to a second valve guide sleeve. Each valve guide sleeve includes a guide bore having a first diameter and a secondary bore having a second diameter. The second diameter is larger than the first diameter. The secondary bore of the first valve guide sleeve is placed adjacent the secondary bore of the second valve guide sleeve and the first valve guide sleeve is secured to the second valve guide sleeve, preferably by an outer sleeve. The first diameter of the guide bore is chosen to be in close fitting engagement with a stem of a valve while the second diameter is not in close fitting engagement. In a second embodiment, the valve guide sleeves are formed as a single unit to produce a one piece valve guide assembly.

21 Claims, 3 Drawing Sheets

CERAMIC VALVE GUIDE WITH TWO INTERNAL DIAMETERS

TECHNICAL FIELD

This invention relates generally to an internal combustion engine and, more particularly, to a ceramic valve guide assembly for insertion into a cylinder head of an internal combustion engine.

BACKGROUND OF THE INVENTION

This invention relates generally to an internal combustion engine and, more particularly, to a valve guide assembly for an internal combustion engine. Present internal combustion engines are being manufactured for increased efficiency and greater horsepower outputs. In order to achieve greater efficiency, exhaust temperatures are increased as less heat is transferred to the cooling system. The increased exhaust temperatures increase the output of any exhaust energy recovery hardware, such as the turbocharger, and subsequently, the performance of the engine.

In conventional engines, engine valve guides have been made from an iron based material. However, these iron based valve guides are not suitable for operating within the high exhaust temperature ranges reached with high efficiency engines. Therefore, to overcome this problem the valve guides for high efficiency engines are typically made from a ceramic material.

An example of a valve guide composed of a ceramic material is disclosed in U.S. Pat. No. 4,688,527 issued to Donald H. Mott, et al. on Aug. 25, 1987. In order to support and sealingly interact with a conventional engine poppet-type valve it is necessary that the valve guide have a through bore for receiving a stem of a valve. In addition, it is typically required that the entire length of the through bore be machined in order to obtain the proper dimensions and surface finish. Many of these high efficiency engines require valve guide assemblies that are quite long, on the order of 92 to 170 millimeters in length. Such long valve guide assemblies require long quills and small diameter grinding wheels to form the through bore and create the proper surface finish. Such long quills are easily distorted when a load is placed on them and therefore, the forces during grinding must be kept low in order to prevent such distortion. In addition, such long quills limit the surface feed rates. The low grinding forces and surface feed rates significantly increase the amount of time required to finish the interior surface of the through bore, thus increasing significantly the cost. The present invention is directed to overcoming the problems set forth above.

SUMMARY OF THE INVENTION

In one aspect of the present invention, a valve guide assembly for an internal combustion engine comprises two valve guide sleeves. Both valve guide sleeves are formed of a ceramic material and each includes a through bore for receiving a stem of a valve. Each of the through bores includes a guide bore having a first diameter that is coaxially aligned with a secondary bore having a second diameter. The first diameter is smaller than the second diameter. The secondary bore of one valve guide sleeve is secured adjacent to the secondary bore of the other valve guide sleeve in such a manner that the through bore of the first valve guide sleeve is coaxially aligned with the through bore of the second valve guide sleeve. Preferably, only the guide bore is further machined to have a surface finish and serves to guide a valve stem.

In another aspect of the present invention, a method of forming a valve guide assembly for an internal combustion engine is disclosed. The method includes the steps of forming two valve guide sleeves from a ceramic material. Then a guide bore having a first diameter is formed in each valve guide sleeve. Next, a secondary bore having a second diameter larger than the first diameter is formed in each valve guide sleeve. The secondary bore is coaxially aligned with and in communication with the guide bore in each of the valve guide sleeves. Next, the secondary bore of one valve guide sleeve is placed adjacent the secondary bore of the other valve guide sleeve and the secondary bore of the first valve guide sleeve is coaxially aligned with the secondary bore of the second valve guide sleeve. Finally, the first valve guide sleeve is secured adjacent to the second valve guide sleeve.

Thus, the present invention, provides a ceramic valve guide assembly that is simple, requires less machining, and is therefore more economical.

These and other features and advantages of this invention will become more apparent to those skilled in the art from the following detailed description of the presently preferred embodiment. The drawings that accompany the detailed description can be described as follows.

DETAILED DESCRIPTION OF THE PREFERRED EMBODIMENT AND INDUSTRIAL APPLICABILITY

Figure 1:
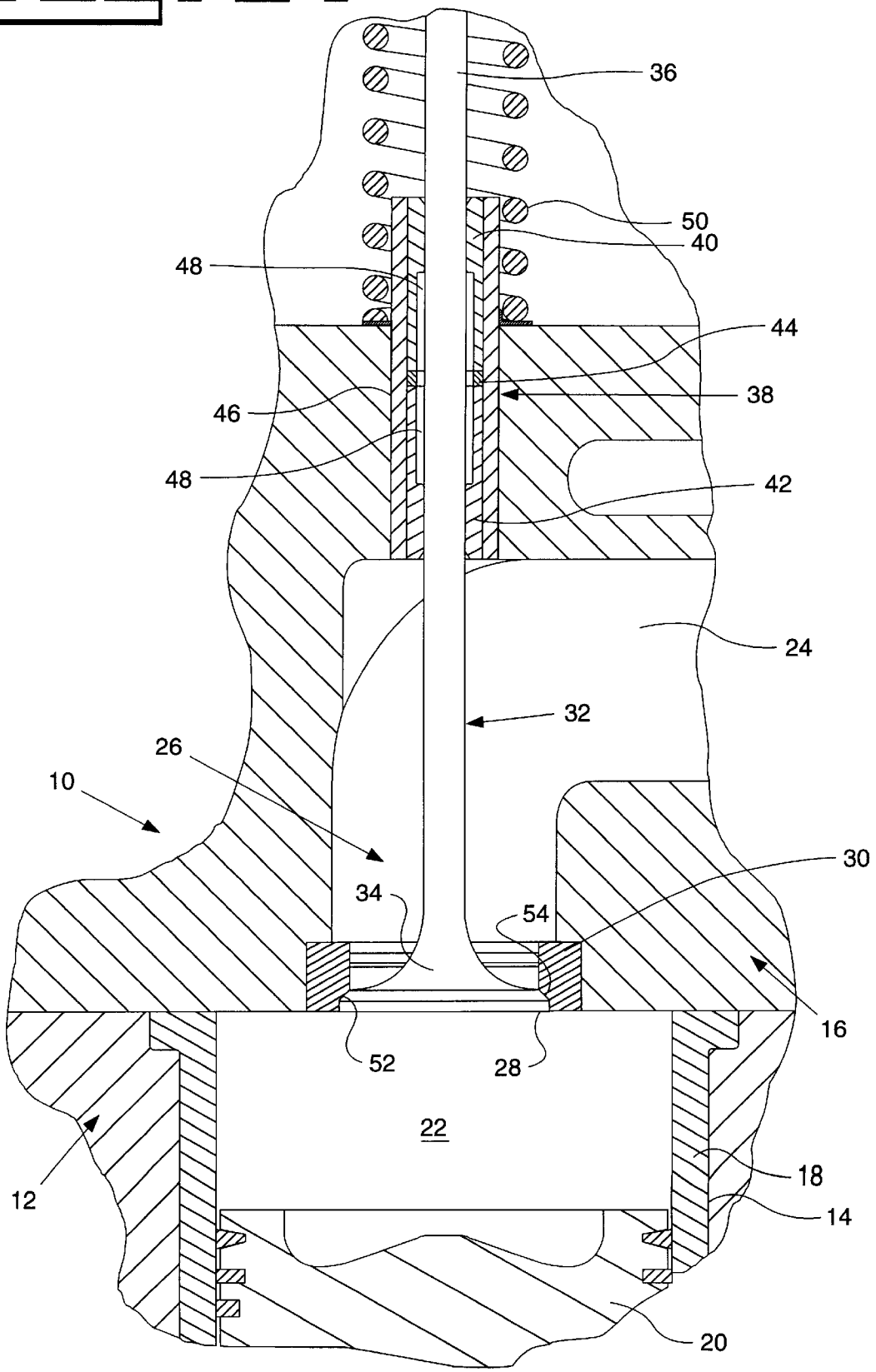
FIG. 1 is a partial sectional view of a combustion chamber of an internal combustion engine incorporating a valve guide assembly designed according to the present invention.

As A partial view of an internal combustion engine is generally shown at 10 in FIG. 1. The internal combustion engine 10 includes a cylinder block 12 defining a cylinder bore 14. A cylinder head 16 is releasably mounted at the upper end of cylinder block 12 in a conventional manner. A cylinder liner 18 is disposed within cylinder bore 14. A piston 20 reciprocates in cylinder liner 18 and cooperates with cylinder head 16 to define a combustion chamber 22. Only a single cylinder has been illustrated and will be described. It should be understood, however, that the invention is capable of use in engines having multiple cylinders and various cylinder configurations.

An exhaust passage 24 is formed within cylinder head 16 and is used for expelling gases out of combustion chamber 22. A valving arrangement 26 is operatively associated and fluidly connected with combustion chamber 22 through an opening 28 encircled by an annular valve seat member 30. The valving arrangement 26 consists of a poppet-type valve 32 commonly used in internal combustion engines. Valve 32 includes an enlarged head portion 34 that is connected to an elongated cylindrical stem 36.

Stem 36 is supported within a valve guide assembly 38 which is mounted into cylinder head 16. Valve guide assembly 38 includes a first valve guide sleeve 40 and a second valve guide sleeve 42. First valve guide sleeve 40 is identical to second valve guide sleeve 42. An annular spacer 44 is located between first valve guide sleeve 40 and second valve guide sleeve 42. First guide valve sleeve 40 and second guide valve sleeve 42 are in abutting relationship with annular spacer 44. An outer sleeve 46 encircles first valve guide sleeve 40, second valve guide sleeve 42, and annular spacer 44.

Both first valve guide sleeve 40 and second valve guide sleeve 42 include a through bore 48. Through bores 48 are coaxially aligned, encircle stem 36, and direct movement of valve 32 in a direct linear path. Movement of valve 32 within valve guide assembly 38 causes enlarged head portion 34 to move toward and away from piston 20 to define an opened and closed position of valve 32, respectively. Valve 32 is shown in the closed position in FIG. 1. Valve 32 is urged to the open position in any suitable manner, such as by a mechanical, hydraulic, or electronic control means. A coil spring 50 encircles stem 36 and acts against a keeper (not shown) to bias valve 32 into the closed position.

Head portion 34 includes an accurately ground inclined surface 52 thereabout which seats on a valve seat surface 54 in valve seat member 30 when valve 32 is in the closed position. Gases are expelled from combustion chamber 22 into exhaust passage 24 when valve 32 is in the open position, as is well known in engine operation. It should be understood that although only an exhaust valve arrangement is described, the present invention may be used on an intake valve arrangement as is known in the art.

Figure 2:
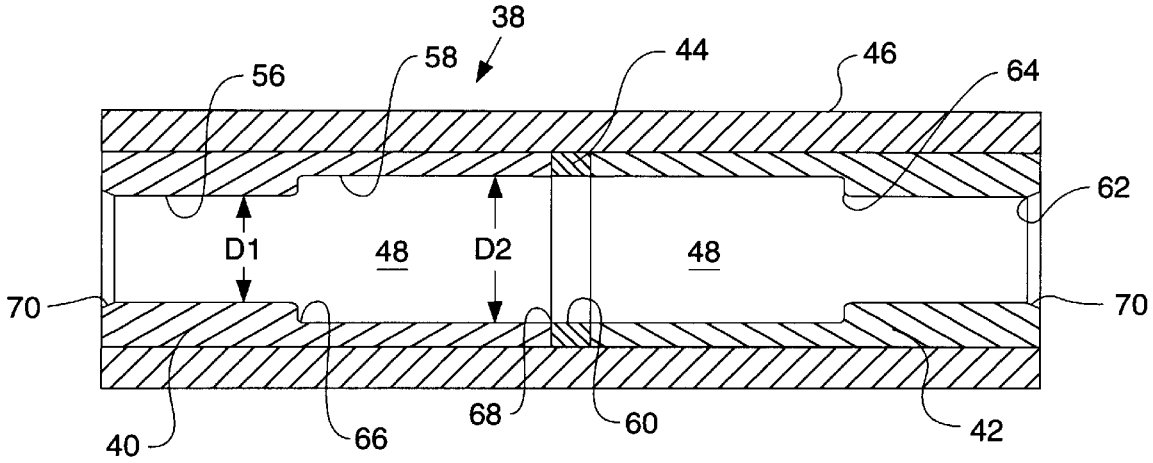
FIG. 2 is a cross-sectional view of a first embodiment of a valve guide assembly designed according to the present invention.

FIG. 2 is a cross-sectional view of a first embodiment of valve guide assembly 38. Each of through bores 48 is comprised of a guide bore 56 and a secondary bore 58. As stated above, first valve guide sleeve 40 is designed identical to second valve guide sleeve 42, thus only first valve guide sleeve 40 will be described. Guide bore 56 has a first diameter, D1, and secondary bore 58 has a second diameter, D2. First diameter, D1, is smaller than second diameter, D2. The diameter of secondary bore 58 is not critical so long as it is larger than first diameter, D1. Annular spacer 44 includes a spacer bore 60. Guide bore 56, secondary bore 58, and spacer bore 60 are all coaxially aligned.

Guide bores 56 are defined by a first end 62 and a second end 64. Preferably, guide bore 56 has a constant diameter equal to first diameter D1 between first end 62 and second end 64. Likewise, secondary bore 58 is defined by a first end 66 and a second end 68. Secondary bore 58 may be tapered between first end 66 and second end 68, see FIG. 3. A relief surface 70 is located adjacent each end of guide bore 56. Relief surface 70 is shown to have a tapered shape, other shapes such as chamfers are permitted as is known in the art. First diameter D1 is chosen to closely encircle stem 36 to thereby ensure direct linear movement of valve 32 and guide bore 56 is machined to have a smooth finish surface.

As described above, first valve guide sleeve 40 and second valve guide sleeve 42 are composed of a ceramic material, such as, for example, silicon nitride, boron carbide, or any suitable ceramic material which has a low coefficient of expansion. In addition, first valve guide sleeve 40 and second valve guide sleeve 42 may be composed of a self-lubricating ceramic material, such as, for example one of the above ceramic materials further including fibers or particulates comprising carbon or graphite. Such self-lubricating ceramics are known in the art. The self-lubricating ceramics also have a low coefficient of expansion. Preferably, the coefficient of expansion is generally within the range of 2.5E-6 to 10.8E-6 mm/mm/C°.

Preferably, the annular spacer 44 and outer sleeve 46 are comprised of a metallic material, such as, for example, steel, aluminum, or other suitable material having a high coefficient of expansion is generally within the range of 14.9E-6 to 25.0E-6 mm/mm/C°.

Figure 3:
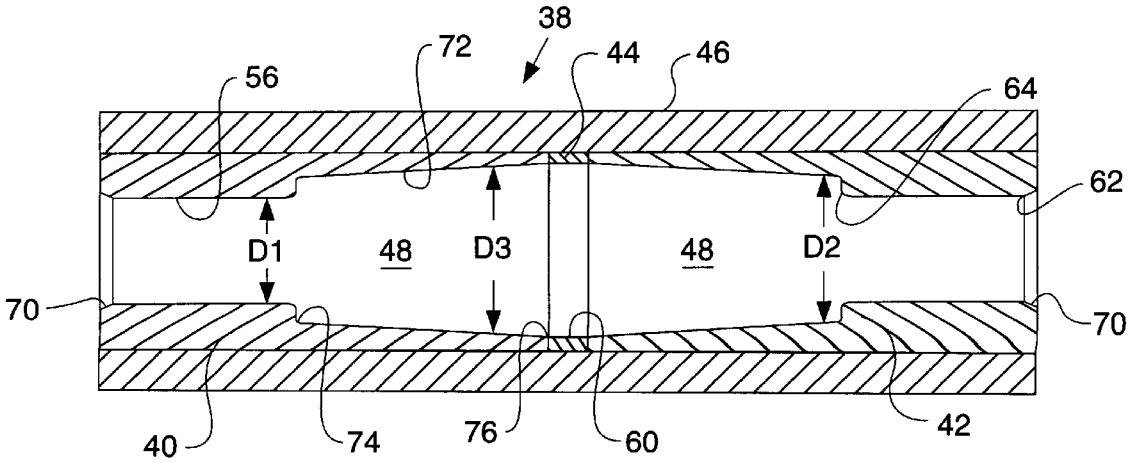
FIG. 3 is a cross-sectional view of a further embodiment of a valve guide assembly designed according to the present invention.

FIG. 3 is a cross-sectional view of an alternative embodiment of a valve guide assembly 71, wherein like structures are designated by like reference numerals to valve guide assembly 38. The only differences between valve guide assembly 71 and valve guide assembly 38 are in the structure of the secondary bores 72 and the relief surfaces 78. Valve guide assembly 71 includes secondary bores 72 defined by a first end 74 and a second end 76. Secondary bore 72 includes a plurality of diameters including a second diameter, D2, and third diameter D3. Second diameter D2 and third diameter D3 are larger than first diameter D1. As described above, all of the diameters of secondary bore 72 are larger than first diameter, D1. Additionally, relief surfaces 70 are formed adjacent guide bore 56. Relief surfaces 70 comprises rounded surfaces.

The method of forming either valve guide assembly 38 or 71 comprises the following steps. Initially, first valve guide sleeve 40 and second valve guide sleeve 42 are formed form a suitable ceramic material, as described above. Preferably, first valve guide sleeve 40 and second valve guide sleeve 42 are formed to have a smooth and constant outer diameter that is the same. Next, guide bore 56 is formed in each of first valve guide sleeve 40 and second valve guide sleeve 42. Preferably, guide bore 56 has a first diameter, D1, that is constant throughout guide bore 56. The size of D1 is selected to provide a close-fitting arrangement with stem 36. Next, secondary bore 58 is formed in each of first valve guide sleeve 40 and second valve guide sleeve 42. Secondary bore 58 is formed to be coaxially a aligned with guide bore 56. Secondary bore 58 is designed to have a second diameter wherein the second diameter is larger than the first diameter. Guide bore 56 is formed to have a smooth surface finish while secondary bore 58 is not further machined. Secondary bore 58 is coaxially aligned with and in communication with guide bore 56. Next, secondary bore 58 of first valve guide sleeve 40 is placed adjacent secondary bore 58 of second valve guide sleeve 42 with secondary bore of first valve guide sleeve 40 coaxially aligned with secondary bore 58 of second valve guide sleeve 42. Preferably, spacer 44 is placed between first valve guide sleeve 40 and secondary valve guide sleeve 42. Finally, first valve guide sleeve 40 is secured adjacent to second valve guide sleeve 42.

In a preferred embodiment, outer sleeve 46 secures first valve guide sleeve 40 to second valve guide sleeve 42 by an interference fit. Annular spacer 44 is designed to prevent stem 36 from contacting second end 68 of secondary bore 58. Preventing this contact reduces wear on stem 36. Likewise, relief surface 70 serves to prevent contact of stem 36 with a sharp edge of either first valve guide sleeve 40 or second valve guide sleeve 42 to also prevent wear of stem 36.

First valve guide sleeve 40, second valve guide sleeve 42 and annular spacer 44 can be introduced into outer sleeve 46 by any of a number of processes that are known in the art. For example, outer sleeve 46 may be heated and/or first valve guide sleeve 40, second valve guide sleeve 42, and annular spacer 44 may be chilled before insertion into outer sleeve 46. A press-fit may also be used to assemble first valve guide sleeve 40, second valve guide sleeve 42 and annular spacer 44 into outer sleeve 46. The press-fit may be accomplished by machining first valve guide sleeve 40 and second valve guide sleeve 42 into frusto-conical shapes which are dimensioned such that an interference fit is obtained between first valve guide sleeve 40, second valve guide sleeve 42 and outer sleeve 46 during assembly. Subsequently, valve guide assembly 38 is shrink-fitted into cylinder head 16 in a conventional manner, as is known in the art.

It is preferred that the length of guide bore 56 between first end 62 and second end 64 be at least 1.5 times the diameter of stem 36. Guide bore 56 may be longer. In addition, any diameter along the length of secondary bore 58 must be greater than first diameter, D1. As described above, only guide bore 56 needs to be machined to have a smooth finish surface therefore reducing formation time of valve guide assembly 38. Valve guide assembly 38 can be used either in a wet or a dry lubrication method as is known in the art. As disclosed above, secondary bore 58 may have a variety of shapes, including tapered shapes. Preferably, guide bore 56 is formed first using the outer surface of first valve guide sleeve 40 as an index. Preferably, guide bore 56 is then machined to have a smooth surface finish. Preferably, secondary bore 58 is formed next, again using outer surface of first valve guide sleeve 40 as an index to assure that guide bore 56 will be coaxially aligned with secondary bore 58. Clearly, the order of formation of guide bore 56 and secondary bore 58 can be reversed.

Figure 4:
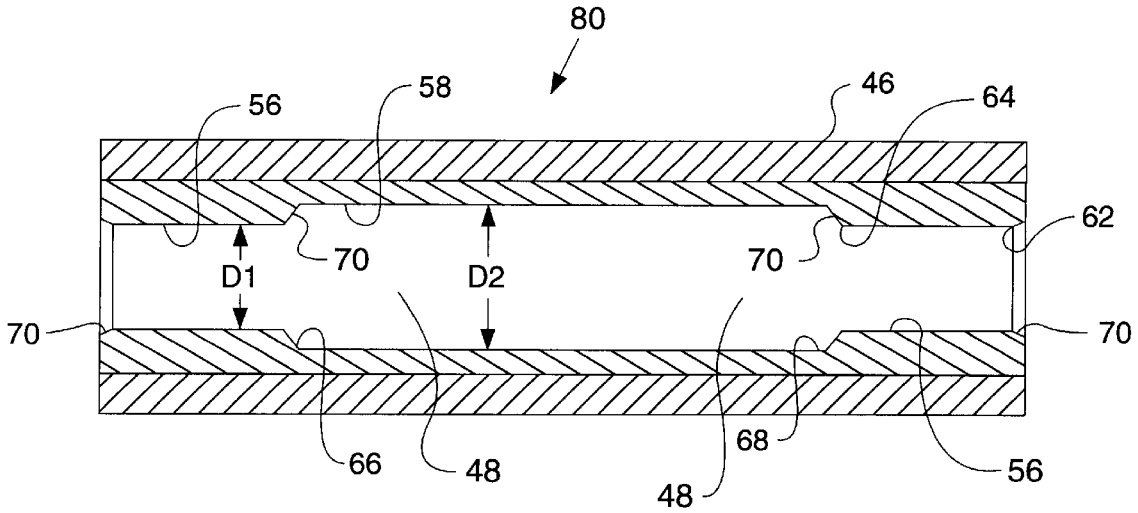
FIG. 4 is a cross-sectional view of a further embodiment of a valve guide assembly designed according to the present invention.

In FIG. 4 an alternative embodiment of a valve guide assembly is shown generally at 80. Valve guide assembly 80 is virtually identical to valve guide assembly 38 as shown in FIG. 2, thus many of the same reference numerals are used, except that valve guide assembly 80 is formed from a single piece rather than two pieces. Valve guide assembly 80 includes through bore 48 which extends through valve guide assembly 80. Through bore 48 is comprised of a pair of guide bores 56 separated by secondary bore 58. Guide bores 56 have a first diameter, D1, and secondary bore 58 has a second diameter, D2. First diameter, D1, is smaller than second diameter, D2. The diameter of secondary bore 58 is not critical so long as it is larger than first diameter, D1. Guide bores 56 are defined by a first end 62 and a second end 64. Preferably, guide bores 56 have a constant diameter equal to first diameter D1 between first end 62 and second end 64. Likewise, secondary bore 58 is defined by a first end 66 and a second end 68. Secondary bore 58 may be tapered between first end 66 and second end 68, see FIG. 3. A relief surface 70 located adjacent each end of guide bore 56. Relief surface 70 is shown to have a tapered shape, other shapes such as chamfers are permitted as is known in the art. First diameter D1 is chosen to closely encircle stem 36 to thereby ensure direct linear movement of valve 32 and guide bore 56 is machined to have a smooth finish surface.

As described above, valve guide assembly 80 is composed of a ceramic material, such as, for example, silicon nitride, boron carbide, or any suitable ceramic material which has a low coefficient of expansion. In addition, valve guide assembly 80 may be composed of a self-lubricating ceramic material, such as, for example one of the above ceramic materials further including fibers or particulates comprising carbon or graphite. Such self-lubricating ceramics are known in the art. The self-lubricating ceramics also have a low coefficient of expansion. Preferably, the coefficient of expansion is generally within the range of 2.5E-6 to 10.8E-6 mm/mm/C°.

In a preferred embodiment, valve guide assembly 80 is introduced into outer sleeve 46 by any of a number of processes that are known in the art and described above.

Valve guide assembly 80 may be produced by any of a number of methods as is known in the art. One such method comprises the use of a die that contains a collapsible or two-piece core that can be removed after pressing of the ceramic material. In addition, valve guide assembly 80 could be formed by using a die having a core composed of a disposable material such as wax or graphite. In such a method, the disposable core is used to shape and form secondary bore 58 and guide bores 56. During sintering the disposable core material melts or is removed. Guide bores 56 are then machined to produce the finished surface as described above.

The present invention has been described in accordance with the relevant legal standards, thus the foregoing description is exemplary rather than limiting in nature. Variations and modifications to the disclosed embodiment may become apparent to those skilled in the art and do come within the scope of this invention. Accordingly, the scope of legal protection afforded this invention can only be determined by studying the following claims.

I claim:

1. A valve guide assembly for an internal combustion engine comprising:

a first valve guide sleeve and a second valve guide sleeve;

each of said first and said second valve guide sleeves formed of a ceramic material and having a through bore for receiving a stem of a valve;

each of said through bores including a guide bore having a first diameter and coaxially aligned with a secondary bore having a second diameter, said first diameter being smaller than said second diameter;

an annular spacer, said annular spacer located between said first and said second valve guide sleeve, said annular spacer having a spacer bore coaxially aligned with said through bores of said first and said second valve guide sleeve, and said secondary bore of each of said first and said second valve guide sleeve abutting against said annular spacer; and said secondary bore of said first valve guide sleeve and said secondary bore of said second valve guide sleeve secured adjacent to said annular spacer and said through bore of said first valve guide sleeve coaxially aligned with said through bore of said second valve guide sleeve.

2. A valve guide assembly for an internal combustion engine as recited in claim 1 wherein said guide bore is defined by a first end and a second end, said guide bore having a relatively constant diameter equal to said first diameter between said first end and said second end.

3. A valve guide assembly for an internal combustion engine as recited in claim 2 wherein each of said guide bores has a length between said first end and said second end that is greater than 1.5 times said first diameter.

4. A valve guide assembly for an internal combustion engine as recited in claim 1 wherein said secondary bore is defined by a first end and a second end, said secondary bore having a plurality of diameters including said second diameter between said first end and said second end, each of said plurality of diameters being greater than said first diameter.

5. A valve guide assembly for an internal combustion engine as recited in claim 1 wherein said annular spacer is formed of a metallic element.

6. A valve guide assembly for an internal combustion engine as recited in claim 1 further comprising an outer sleeve, said outer sleeve receiving said first and said second valve guide sleeve, said outer sleeve thereby securing said secondary bore of said first valve guide sleeve adjacent to said secondary bore of said second valve guide sleeve.

7. A valve guide assembly for an internal combustion engine as recited in claim 6 wherein said outer sleeve is formed of a metallic material.

8. A valve guide assembly for an internal combustion engine as recited in claim 1 wherein each of said first and said second valve guide sleeves further include a relief surface located adjacent said guide bore.

9. A valve guide assembly for an internal combustion engine as recited in claim 1 wherein said ceramic material comprises a self-lubricating ceramic material.

10. A method of forming a valve guide assembly for an internal combustion engine comprising the steps of:

a.) forming a first valve guide sleeve and a second valve guide sleeve from a ceramic material;

b.) forming a guide bore having a first diameter in each of said first and said second valve guide sleeves;

c.) forming a secondary bore having a second diameter larger than said first diameter in each of said first and said second valve guide sleeves, said secondary bore coaxially aligned with and in communication with said guide bore;

d.) forming an annular spacer having a spacer bore; placing said annular spacer between said secondary bore of said first valve guide sleeve and said secondary bore of said second valve guide sleeve; coaxially aligning said spacer bore with said secondary bore of said first valve guide sleeve and said secondary bore of said second valve guide sleeve; abutting said secondary bore of said first valve guide sleeve and said secondary bore of said second valve guide sleeve against said annular spacer; and coaxially aligning said secondary bore of said first valve guide sleeve with said secondary bore of said second valve guide sleeve; and e.) securing said first valve guide sleeve and said second valve guide sleeve adjacent to said annular spacer.

11. A method as recited in claim 10 wherein step b.) comprises the further step of forming said guide bore to have a relatively constant diameter equal to said first diameter.

12. A method as recited in claim 10 wherein step c.) comprises the further step of forming said secondary bore to have plurality of diameters including said second diameter, each of said plurality of diameters being larger than said first diameter.

13. A method as recited in claim 10 comprising the further step of forming said annular spacer from a metallic element.

14. A method as recited in claim 10 wherein step e.) comprises the further steps of:

forming an outer sleeve;

inserting said first valve guide sleeve and said second valve guide sleeve into said outer sleeve with said secondary bore of said first valve guide sleeve adjacent to and coaxially aligned with said secondary bore of said second valve guide sleeve; and forming an interference fit between said outer sleeve and said first and said second valve guide sleeve, thereby securing said first valve guide sleeve adjacent to said second valve guide sleeve.

15. A method as recited in claim 14 comprising the further step of forming said outer sleeve from a metallic element.

16. A method as recited in claim 14 comprising the further step of inserting said valve guide assembly into a cylinder head of an internal combustion engine.

17. A method as recited in claim 10 comprising the further step of forming a relief surface adjacent said guide bore on each of said first and said second valve guide sleeve.

18. A method as recited in claim 17 wherein the step of forming said relief surface comprises the further step of forming a tapered relief surface adjacent said guide bore.

19. A valve guide assembly for an internal combustion engine comprising:

a valve guide assembly formed of a ceramic material and having a through bore for receiving a stem of a valve;

said through bore including a pair of guide bores each defined by a first end and a second end and having a first diameter and coaxially aligned with and spaced apart by a secondary bore having a second diameter, said first diameter being smaller than said second diameter and a relief surface located adjacent said first end and said second end of each of said guide bores.

20. A valve guide assembly for an internal combustion engine as recited in claim 19 wherein each of said guide bores have a relatively constant diameter equal to said first diameter between said first end and said second end.

21. A valve guide assembly for an internal combustion engine as recited in claim 20 wherein each of said guide bores has a length between said first end and said second end that is greater than 1.5 times said first diameter.

* * * * *